US011822293B2

(12) United States Patent
Chouet

(10) Patent No.: US 11,822,293 B2
(45) Date of Patent: Nov. 21, 2023

(54) WATCH HAVING A VARIABLE DIAL

(71) Applicant: Claude Chouet, Houtaud (FR)

(72) Inventor: Claude Chouet, Houtaud (FR)

( * ) Notice: Subject to any disclaimer, the term of this patent is extended or adjusted under 35 U.S.C. 154(b) by 148 days.

(21) Appl. No.: 17/439,181

(22) PCT Filed: Mar. 12, 2020

(86) PCT No.: PCT/IB2020/052257

§ 371 (c)(1),
(2) Date: Sep. 14, 2021

(87) PCT Pub. No.: WO2020/183423

PCT Pub. Date: Sep. 17, 2020

(65) Prior Publication Data

US 2022/0163926 A1 May 26, 2022

(30) Foreign Application Priority Data

Mar. 14, 2019 (FR) ..... 1902619

(51) Int. Cl.
*G04B 45/00* (2006.01)
*G04B 19/06* (2006.01)
(Continued)

(52) U.S. Cl.
CPC ..... *G04B 45/003* (2013.01); *G04B 19/065* (2013.01); *G04B 19/10* (2013.01); *G04B 47/044* (2013.01)

(58) Field of Classification Search
CPC .... G04B 45/003; G04B 47/044; G04B 19/10; G04B 19/065; G04B 19/16;
(Continued)

(56) References Cited

U.S. PATENT DOCUMENTS 319,804 A * 6/1885 Ethridge ..... G04B 19/16 368/231
347,337 A * 8/1886 Ethridge ..... G04B 19/16 368/231
(Continued)

FOREIGN PATENT DOCUMENTS

CH 700261 A2 7/2010
CH 699134 B1 10/2011
DE 9010470 U1 10/1990

OTHER PUBLICATIONS

Excerpt from "Illustrated Professional Dictionary of Horology" providing standard definition of "bezel" (2023), accessible at https://www.fhs.swiss/berner/?l=en (Year: 2023).*
(Continued)

*Primary Examiner* — Edwin A. Leon
*Assistant Examiner* — Sean R Brannon
(74) *Attorney, Agent, or Firm* — ZarleyConley PLC

(57) ABSTRACT

The invention relates to a watch having a variable dial, and more specifically a watch that provides the wearer with the possibility of partially changing the appearance of the dial. According to the invention, the watch has a dial (1) that has at least one opening (6, 7) occupied by a removable bezel (3, 5) and the watch further has a plurality of carrying arms (9, 10) disposed radially on a carousel (8), each arm end situated on the circumference carrying a bezel (3, 5) and the carousel (8) being able to rotate about an axis perpendicular to the plane of the dial (1) and passing through the center thereof.

10 Claims, 4 Drawing Sheets

Figure 1:
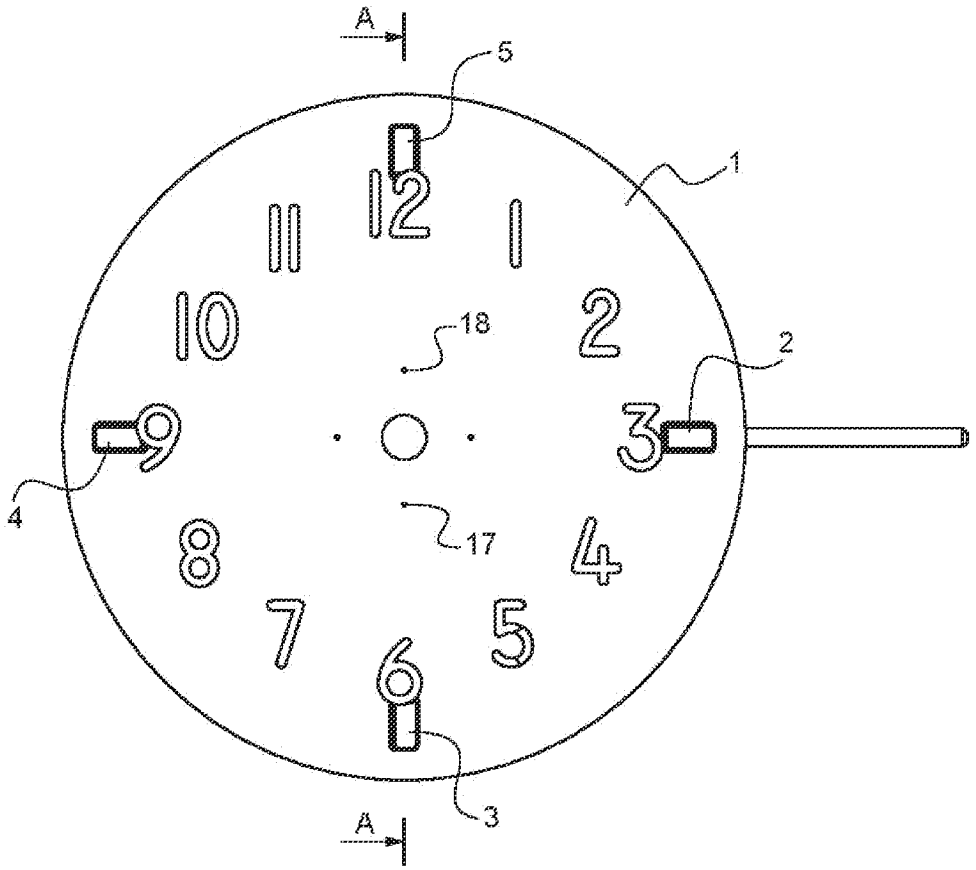

(51) Int. Cl.
*G04B 19/10* (2006.01)
*G04B 47/04* (2006.01)

(58) Field of Classification Search
CPC ..... G04B 45/0038; G04B 47/042; G04B 19/163; G04B 19/166; G04B 47/046; G04B 47/04
See application file for complete search history.

(56) References Cited

U.S. PATENT DOCUMENTS 384,737 A * 6/1888 Bickford ..... G04B 19/16 368/231
393,000 A * 11/1888 Ethridge ..... G04B 19/16 368/231
400,734 A * 4/1889 Bickford ..... G04B 19/16 368/231
401,697 A * 4/1889 Ethridge ..... G04B 19/16 368/231
403,525 A * 5/1889 Ethridge ..... G04B 19/16 368/231
2011/0069590 A1* 3/2011 Jolidon ..... G04B 47/042 368/190

OTHER PUBLICATIONS

International Searching Authority, "Notification of Transmittal of The International Search Report and The Written Opinion of the International Searching Authority", for PCT/IB2020/052257, dated Jul. 20, 2020, 7 pages.
English Translation of International Searching Authority, "Notification of Transmittal of The International Search Report and The Written Opinion of the International Searching Authority", for PCT/IB2020/052257, dated Jul. 20, 2020, 6 pages.
CH700261A2—English Translation Abstract.
CH699134B1—English Translation Abstract.

* cited by examiner

WATCH HAVING A VARIABLE DIAL

The invention relates to a watch having a variable dial, and more specifically a watch that provides the wearer with the possibility of partially changing the appearance of the dial.

BACKGROUND OF THE INVENTION

According to document EP 61519, watches have long been known already whose front face can be changed, by removing, turning over, or interchanging rings surrounding the hands and bearing different numbers.

SUMMARY OF THE INVENTION

The goal of the invention is to propose a watch whose appearance can be changed by partially modifying the color, the material, and/or the relief of the dial of this watch.

According to the invention, this goal is achieved by a watch in accordance with the following point 1:

1. A watch whose dial has at least one opening occupied by a removable bezel, this watch having a plurality of carrying arms disposed radially on a carousel, each arm end situated on the circumference carrying a bezel and the carousel being able to rotate about an axis perpendicular to the plane of the dial and passing through the center thereof.

Advantageous characteristics of the watch in point 1 above are indicated in the following points 2 to 11:

2. A watch according to point 1, in which the bezels can be inserted in turn into the opening, when one of the bezels is in the opening, the other or the others is/are behind the dial.
3. A watch according to point 1 or 2, in which each carrying arm can pivot from a lowered position to a raised position.
4. A watch according to point 3, comprising rotation means for rotating the carousel and pivoting means for pivoting said carrying arms between their lowered and raised positions.
5. A watch according to point 4, in which the rotation means are capable of engaging with the crown of the watch.
6. A watch according to point 5, in which the rotation means comprise a sliding pinion, a gear train, a toothed wheel, and a finger-piece for engaging with the latter.
7. A watch according to point 5 or 6, in which the pivoting means comprise a spring, a frustoconical part, and a holding ring, pinching arms, a fixing part for the pinching arms, a lever connected to the pinching arms and to the winding stem and a pin connecting the two pinching arms to each other and to the lever.
8. A watch according to point 7, in which the frustoconical part has, on its upper face turned towards the dial, at its center, a bore designed to house the spring.
9. A watch according to point 3 or one of points 4 to 6 dependent on point 4, in which the dial is provided with pins capable of engaging with the carrying arms in order to cause the latter to pivot to their lowered position to a fully raised position.
10. A watch according to point 9, in which the pins are arranged so that the projection of their longitudinal axis on the plane of the dial is on a straight line connecting the openings to the center of the dial.
11. A watch according to point 7 or one of points 8 to 10 dependent on point 7, in which the dial has on its rear face a bore and the frustoconical part, on its upper face, a locking pin designed to fit into this bore.

Figure 2:
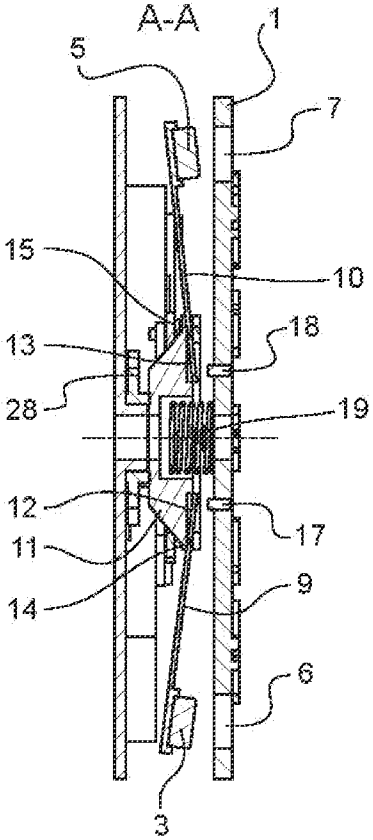
Figure 3:
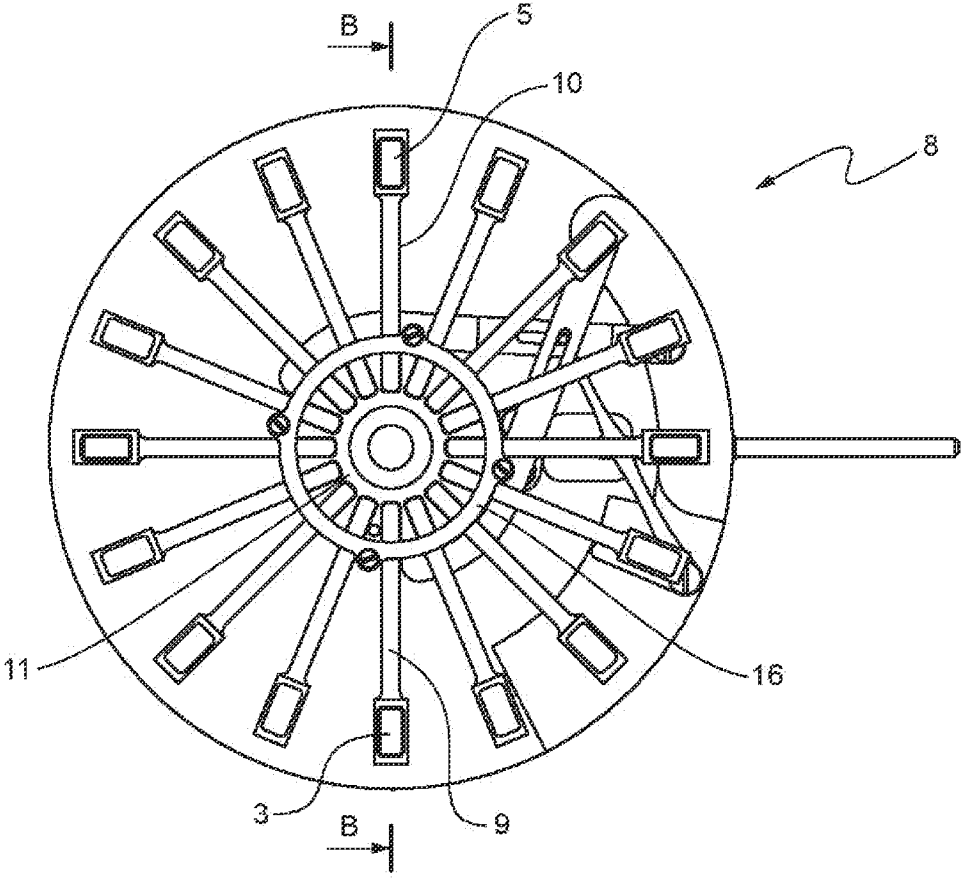
Figure 4:
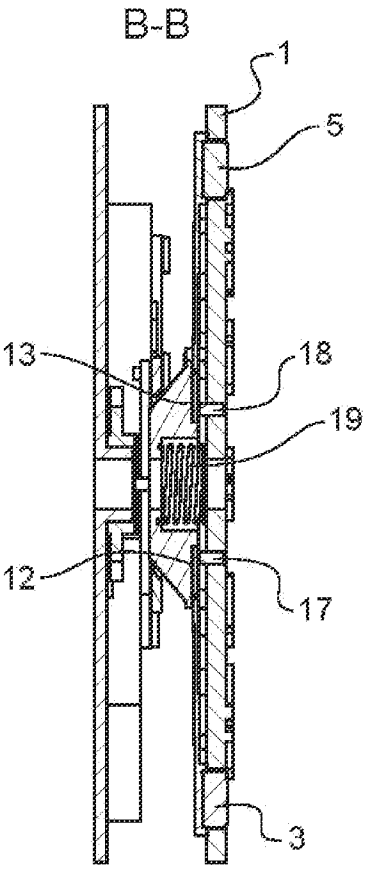
Figure 5:
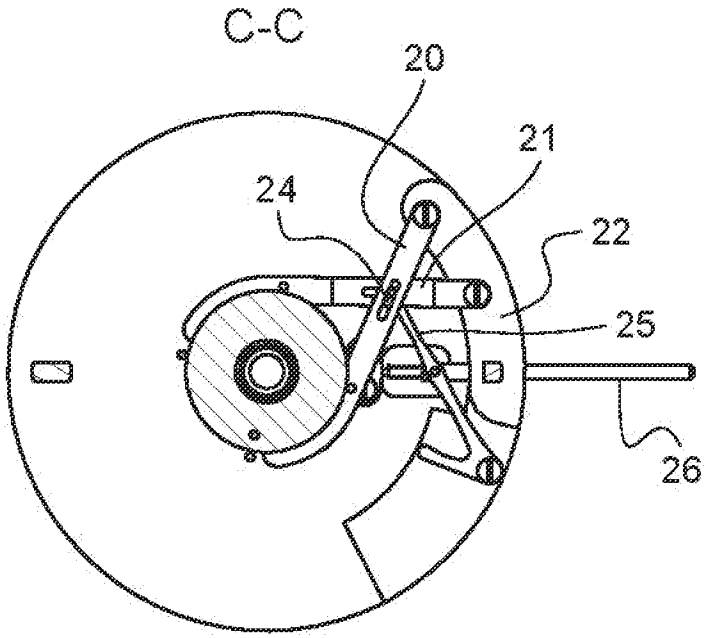
Figure 6:
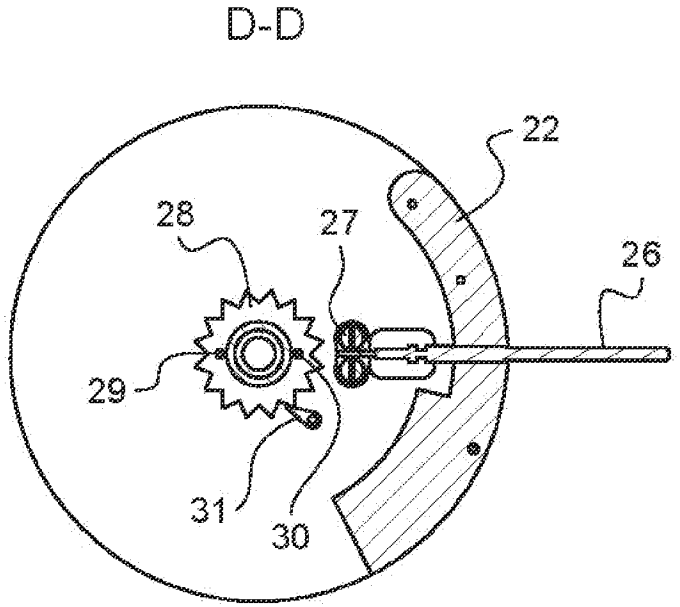
Figure 7:
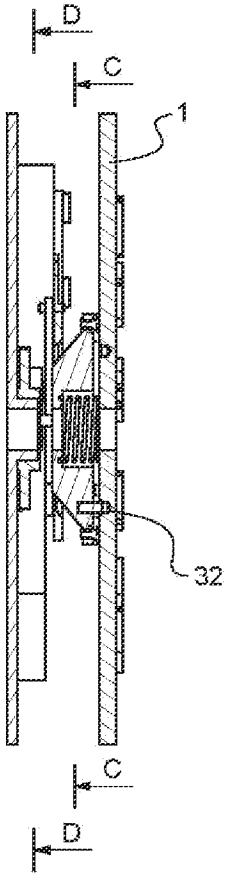

Other characteristics and advantages of the invention will now be described in detail in the following description which is given with reference to the appended figured, which schematically show:

FIG. 1: the front side of the dial of a watch according to the invention;

FIG. 2: a section along the line A-A of the watch according to the invention whose dial is shown in FIG. 1;

FIG. 3: a top view of the inside of the watch according to the invention, after removal of the dial;

FIG. 4: a section along the line B-B of FIG. 3;

FIG. 5: a section, along the line C-C, parallel to the plane of the dial showing a detail of the watch according to the invention;

FIG. 6: another section, along the line D-D, parallel to the plane of the dial showing another detail of the watch according to the invention; and FIG. 7: a section perpendicular to the plane of the dial and passing through the center of the latter, i.e., parallel to the main axis of the watch according to the invention.

DETAILED DESCRIPTION OF THE INVENTION

An embodiment of the watch having a variable dial according to the invention is shown in FIGS. 1 to 7.

The watch according to the invention comprises a dial 1 provided with at least one bezel, in the individual case, four bezels 2, 3, 4, and 5 seen in FIG. 1 and which removably occupy four corresponding openings of which only two, numbered 6 and 7, associated with bezels 3 and 5, respectively, appear in FIG. 2.

The bezels can all have the same color or have different colors and/or surface states (reliefs, textures) that are identical or different. Their precise shape does not matter, provided that their upper face can occupy an opening in its entirety, with the exception of a functional clearance necessary to allow the entry and exit of the bezel in this opening.

The bezels are generally parallelepipedic. But they could also have a circular, oval, triangular, or other shape. Their thickness does not matter. They may project relative to the plane of the dial 1, but in a limited manner, so as not to prevent the hands of the watch from passing through. Of course, the shape of the opening corresponds to the shape of the bezel.

Due to their removable nature, the bezels can be removed from the openings they occupy to be replaced by other bezels that are invisible to the wearer of the watch from the front side of the dial. These other bezels normally have different colors and/or surface states.

Preferably, the watch has a plurality of carrying arms disposed radially, each carrying arm end situated on the circumference carrying a bezel. For example, bezels 3 and 5 of FIG. 2 are carried respectively by carrying arms 9 and 10.

All the carrying arms can pivot from a lowered position, where they are masked by the dial, to a raised position. Similarly, all the bezels can pass from a lowered position to a raised position.

For such a pivoting to be possible, the free ends 12, 13 of the carrying arms 9, 10, seen in FIG. 2, are situated close to the center of the frustoconical part 11. The carrying arms 9, 10 have pivoting points 14, 15 situated between the free ends 12, 13 and those carrying the bezels 3, 5. The pivoting points 14, 15 are formed between the upper face of the frustoconical part 11 and a holding ring 16, which can be seen better in FIG. 3, which is fixed, for example by screwing, on the upper face of the frustoconical part 11, leaving a space for the carrying arms 9, 10.

For the bezels 3, 5 to be able to pass from the lowered position in FIG. 2 to the fully raised position in FIGS. 1 and 4, in which they appear in an opening 6, 7 of the dial 1, their carrying arms 9, 10 must themselves be able to pass from their lowered position to their fully raised position seen in FIG. 4. Such a passage takes place when pins 17, 18 (seen in FIGS. 1 and 2) rest on the free ends 12, 13 of the carrying arms 9, 10. These pins 17, 18 are arranged so that the projection of their longitudinal axis on the plane of the dial 1 is on a straight line connecting the openings 3, 5 to the center of the dial 1. This way, when the pins fulfill their function, the bezels 3, 5 can penetrate openings 6, 7, respectively.

In order for the pivoting of the carrying arms 9, 10 to be possible, it is necessary for the pins 17, 18 to be able at times to come into contact, or at times to be away from the free ends 12, 13 of the carrying arms 9, 10. Such an alternation is made possible by the displacement of the carousel 8, and therefore of the frustoconical part 11, along the main axis of the watch, i.e., the axis passing through the center of the dial 1 and perpendicular to the latter.

The frustoconical part 11 has a bore at its center allowing it to house a spring 19 seen in particular in FIGS. 2 and 4. When this spring 19 is compressed, as can be seen in FIG. 4, the frustoconical part 11 is close to the dial 1, the pins 17, 18 resting therefore on the free ends 12, 13 of the carrying arms 9, 10, thus causing them to pivot and pass into their fully raised position and thus causing the bezels 3, 5 to penetrate the openings 6, 7. It follows that these bezels 3, 5 become visible to the wearer of the watch.

When the spring 19 is relaxed, as can be seen in FIG. 2, it moves the frustoconical part 11 away from the dial 1 and therefore the pins 17, 18 of the free ends 12, 13 of the carrying arms 9, 10, and thus causes, due to the weight of the bezels 3, 5, the pivoting of the carrying arms 9, 10 and their passage into the lowered position.

The axial displacement of the frustoconical part 11 takes place due to the action of the spring 19, but it is controlled by two pinching arms 20, 21 seen in FIG. 5. These pinching arms 20, 21 preferably have a straight part extending into a curved part in order to reduce the angular displacement of the pinching arms 20, 21 necessary to pinch the cylindrical part 11. The two pinching arms 20, 21 effectively work together to pinch the frustoconical part 11.

The free ends of the pinching arms 20, 21 are fixed to a fixing part 22 joined together with the frame of the watch. The straight parts of the pinching arms 20, 21 intersect approximately at their middle and, at their intersection, they each have an oblong hole traversed by a pin 24 joined together with one end of a lever 25, the other end of this lever 25 being mounted so as to pivot on the fixing part 22. Between these two ends of the lever 25, the winding stem 26 of the watch is connected. As such, when the winding stem 26 is pulled, the lever 25 is also pulled and the end of the latter carrying the pin 24 displaces the latter inside the oblong holes of the arms 20, 21. Such a displacement causes the curved ends of the arms 20, 21 to move away from each other, which causes a release of the pinching exerted on the frustoconical part 11. The latter can then move under the pressure of the spring 19 and move axially away from the dial 1, thus disengaging the bezels 3, 5 from the latter, as explained previously.

In this pulled-out position, the winding stem 26 can also rotate about its longitudinal axis. When the wearer of the watch then rotates the crown of the watch, this crown jointly rotates the winding stem 26.

The end of the winding stem 26 opposite the end where the crown is driven is provided with a sliding pinion (not shown) capable of meshing with a gear train 27 seen in FIG. 6 and engaging with a finger-piece (not shown), causing the rotation of a toothed wheel 28 joined together by two pins 29, 30 of the frustoconical part 11.

The rotation of the toothed wheel 28 obstructed by the jumper 31, causes that of the entire carousel 8 comprising, in addition to this toothed wheel 28, the frustoconical part 11, the carrying arms 9, 10 carrying the bezels 3, 5, the other arms/bezels, and the holding ring 16.

It is therefore possible in this way to install new arms/bezels under the openings in dial 1. Once the new arms/bezels have been chosen by rotating the carousel 8, the wearer of the watch can (see FIG. 5) press on the crown of the watch to cause the winding stem to retract, thus disengaging the sliding pinion from the gear train and acting on the lever 25 and the pinching arms 20, 21 so that the latter pinch the frustoconical part 11 in order to bring it closer to the dial 1, which allows the pins 17, 18 to press on the free ends of the new arms and causes the insertion of the new bezels into the openings.

The jumper 31 preferably has a sufficient thickness to allow it to remain in contact with the toothed wheel 28 when the latter rises and falls jointly with the frustoconical part 11. The jumper 31 allows the toothed wheel 28 to be in a correct angular position to engage with the finger-piece which is provided to cause it to rotate.

Preferably, a locking pin 32 seen in FIG. 7 is provided on the upper face of the frustoconical part 11 to engage in a corresponding bore provided on the rear side of the dial 1 and prevent the carousel 8 from rotating.

The invention claimed is:

1. A watch comprising a dial (1) having at least one opening (6, 7) occupied by a removable bezel (3, 5), the watch having a plurality of carrying arms (9, 10) disposed radially on a carousel (8), each arm end situated on a circumference carrying the bezel (3, 5) and the carousel (8) being able to rotate about an axis perpendicular to the plane of the dial (1) and passing through the center thereof; wherein each carrying arm (9, 10) can pivot from a lowered position to a raised position.

2. The watch according to claim 1, in which the bezels (3, 5) can be inserted in turn into the opening (6, 7) and, when one of the bezels (3, 5) is in the opening, the other or the others is/are behind the dial (1).

3. The watch according to claim 1, comprising rotation means (27, 28) for rotating the carousel (8) and pivoting means (11, 16, 19, 24, 25) for pivoting said carrying arms (9, 10) between their lowered and raised positions.

4. The watch according to claim 3, in which the rotation means are capable of engaging with a crown of the watch.

5. The watch according to claim 4, in which the rotation means comprise a sliding pinion, a gear train (27), a toothed wheel (28), and a finger-piece for engaging with the latter.

6. The watch according to claim 4, in which the pivoting means comprise a spring (19), a frustoconical part (11), and a holding ring (16), pinching arms (20, 21), a fixing part (22) for the pinching arms (20, 21), a lever (25) connected to the pinching arms (20, 21) and to a winding stem and to a pin (24) connecting the pinching arms (20, 21) to each other and to the lever (25).

7. The watch according to claim 6, in which the frustoconical part (11) has, on its upper face turned towards the dial (1), at its center, a bore designed to house the spring (19).

8. The watch according to claim 6, in which the dial (1) has a second bore on its rear face and the frustoconical part (11) on its upper face, and a locking pin (32) designed to fit into the second bore.

9. The watch according to claim 3, in which the dial (1) is provided with a plurality of pins (17, 18) capable of engaging with the carrying arms (9, 10) in order to cause the latter to pivot from their lowered position to a fully raised position.

10. The watch according to claim 9, in which the plurality of pins (17, 18) are arranged so that the projection of their longitudinal axis on the plane of the dial (1) is on a straight line connecting the openings (3, 5) to the center of the dial (1).

* * * * *